US006496152B2

(12) United States Patent
Nilsson

(10) Patent No.: US 6,496,152 B2
(45) Date of Patent: Dec. 17, 2002

(54) DUAL POLARIZED ANTENNA

(76) Inventor: Jack Nilsson, 699 Braddocks Landing, Medina, OH (US) 44256

( * ) Notice: Subject to any disclaimer, the term of this patent is extended or adjusted under 35 U.S.C. 154(b) by 0 days.

(21) Appl. No.: 09/803,245

(22) Filed: Mar. 9, 2001

(65) Prior Publication Data

US 2001/0048398 A1 Dec. 6, 2001

Related U.S. Application Data

(60) Provisional application No. 60/188,464, filed on Mar. 10, 2000.

(51) Int. Cl.[7] ..... H01Q 1/32
(52) U.S. Cl. ..... 343/713; 343/715
(58) Field of Search ..... 343/704, 711, 343/713, 715, 773, 808, 846; H01Q 1/32

(56) References Cited

U.S. PATENT DOCUMENTS 2,218,707 A * 10/1940 Franz ..... 343/715
3,383,694 A * 5/1968 Strohmeyer ..... 343/715
4,253,099 A * 2/1981 Yamazaki et al. ..... 343/713
4,958,167 A * 9/1990 Schroeder ..... 343/853
5,406,295 A * 4/1995 Baranski et al. ..... 343/713
5,805,113 A * 9/1998 Ogino et al. ..... 343/713

* cited by examiner

*Primary Examiner*—Tho G. Phan
(74) *Attorney, Agent, or Firm*—Plunkett & Looney, P.C.; Arnold S. Weintraub

(57) ABSTRACT

A dual polarization antenna for receiving and transmitting high frequency signals in conjunction with a substantially horizontal conducting vehicle panel defining a ground plane comprises three electrically conductive radiative elements, each radiative element being generally linear and extending between a proximal end and a distal end, and an electrically conducting mount (insulated from the vehicle panel) for securing the proximal ends together at a common point and in electrical circuit relation with one another for connection to a transceiver in the vehicle. The radiative elements extend vertically upwardly and outwardly from the common point whereby to form an imaginary cone with the proximal ends forming the apex of the cone. The radiative elements are of different lengths and disposed at an angle relative to the ground plane to provide horizontal and vertical polarization in a first, second and third frequency band.

11 Claims, 2 Drawing Sheets

FIG 1
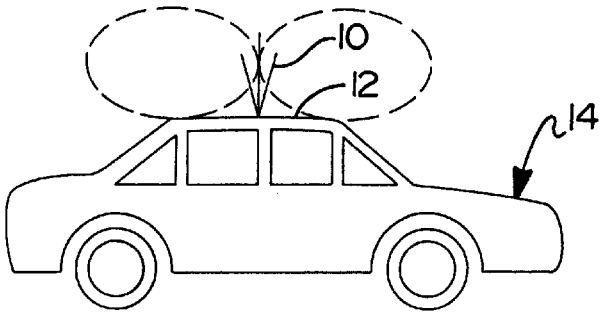
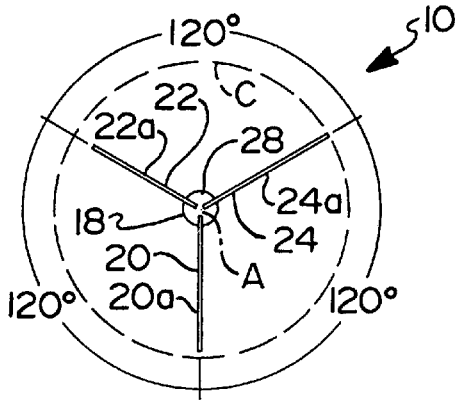
FIG 2
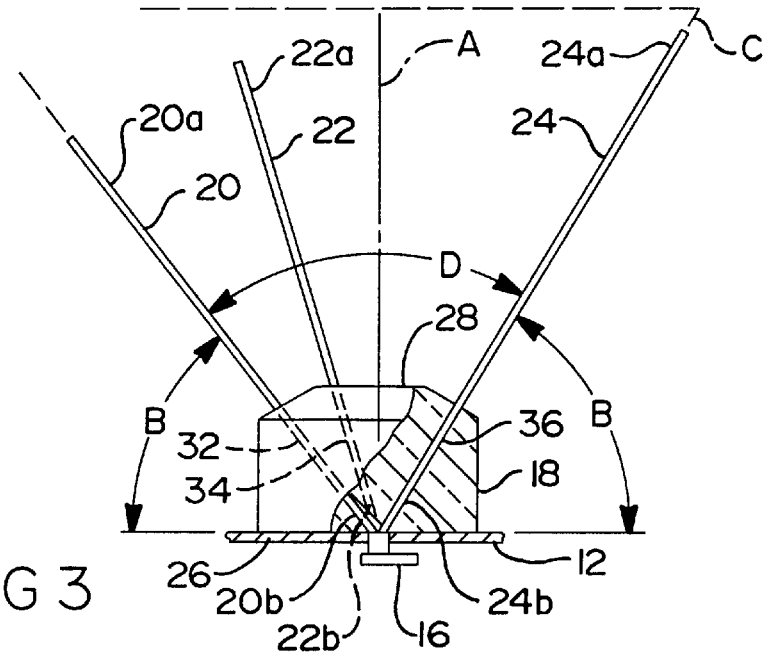
FIG 3

DUAL POLARIZED ANTENNA

This application claims the benefit of Provisional application Ser. No. 60/188,464, filed Mar. 10, 2000.

FIELD OF THE INVENTION

This invention relates to mobile antennas and more particularly to a dual polarized tri-band antenna for use in vehicles.

DESCRIPTION OF RELATED ART

Currently there is a growing need for wireless mobile telephones. Common places on a vehicle for mounting mobile antennas include the roof, rain gutter, bumper, trunk lid, mirror bracket, fender and the side of the vehicle. The simplest mobile VHF/UHF antenna is the quarter wave vertical "whip" antenna mounted on a high grade standoff insulator on the roof of a car. The metal body of the vehicle serves as a ground plane but can distort the normal circular radiation pattern of a vertical antenna.

At the center frequency of the citizen's band (27.185 MHz) a quarter wave antenna is 108.62 inches (about 10 feet). Such an antenna can strike many overhead obstructions, causing it to bend and alter the angle of radiation when the vehicle is moving. Mounting a 10 foot antenna on the roof of a car is not feasible. An antenna that is physically shorter than a quarter wavelength must have inserted into it a suitable loading coil to bring its electrical length up to a quarter wave.

The performance of a mobile whip antenna can be improved by adding capacitance to the portion of the antenna above the loading coil. This capacitance tends to resonate with the inductance of the coil. Since the impedance of the whip antenna is lower than that of the coaxial line that brings power from the transmitter, an impedance matching network is needed.

Additionally, in general, an antenna must be tuned to the same frequency band that the radio system to which it is connected operates in, otherwise transmission and/or reception can be impaired. For the strongest signals, the transmitting and receiving signals each should have the same polarization, either horizontal or vertical. Oftentimes communication must be between stations which use vertical polarization and horizontal polarization. Reflections/refractions due to buildings/land masses cause cross-polarization of signals. Polarization of satellite signals is circular.

It is a general object of this invention to provide an improved multiband antenna which is horizontally and vertically polarized and effective to transmit and receive in the broad frequency bands 140–170 MHz, 200–225 MHz and 400–480 MHz to include land mobile, HAM and satellite uses Another object of this invention is the provision of a mobile antenna which is compact and of low height which permits mounting on the top of a vehicle.

Still another object of this invention is the provision of an antenna which does not require lossy band restrictive coils or windings (to bring the electrical length of the antenna up to a requisite wavelength) or tuning capacitors, thus providing an increase in signal strength.

Yet another object of this invention is the provision of a multi-element antenna system that significantly reduces flutter (picket-fencing) in the signal.

SUMMARY OF THE INVENTION

In accordance with the present invention there is provided a dual polarization antenna for receiving and transmitting high frequency (VHF/UHF) signals in conjunction with a substantially horizontal conducting vehicle panel defining a ground plane, said dual polarization antenna comprising:

a first, second and third radiative element each comprised of an electrically conductive material, each said radiative element being generally linear and extending between a proximal end and a distal end, and means mountable of the vehicle panel for securing the proximal ends together at a common point and in electrical circuit relation with one another, the radiative elements extending vertically upwardly and outwardly from said common point whereby to form an imaginary cone with the proximal ends forming the apex of the cone, said radiative elements each being of a different length and disposed at an angle relative to the ground plane to provide horizontal and vertical polarization and jointly resonate in a first, second and third frequency band.

In a preferred embodiment, the motor vehicle defines an electrical ground potential and the antenna is electrically insulated from said motor vehicle ground potential. The radiative elements forming the cone are disposed at an angle of between 15° to 45° relative to the geometric axis of the cone. and the distal ends are circumferentially spaced at 120°.

Preferably, the radiative elements forming the cone are disposed at an angle of about 60° to the ground plane and resonate in the frequency bands of about 140–170 MHz, 200–225 MHz and 400–480 MHz; and the length of the first, second and third radiative element is, respectively, about 16¾ inches, 18½ inches and 19 inches, Advantageously, an antenna having the above construction eliminates "lossy" coils, capacitors and matching structures and has high power handling capabilities (200+watts); achieves transceiving efficiency/gain in multiple frequency bands; provides broad frequency in each frequency band; reduces null/flutter problems; provides effective "dual" polarization radiation away from the horizon in addition to efficient "near" horizon pattern; and provides extremely wide efficient continuous frequency receiving capabilities in a simple but compact construction.

The novel features of this invention are set forth with particularity in the appended claims. The invention itself will be best understood from the following description when read in connection with the accompanying drawings.

BRIEF DESCRIPTION OF THE DRAWINGS

FIG. 1 is a perspective view of an antenna according to the present invention shown mounted to a vehicle, FIG. 2 is a top plan view of the antenna, FIG. 3 is a side elevation view of the antenna.

DETAILED DESCRIPTION OF THE PREFERRED EMBODIMENT

Figure 4:
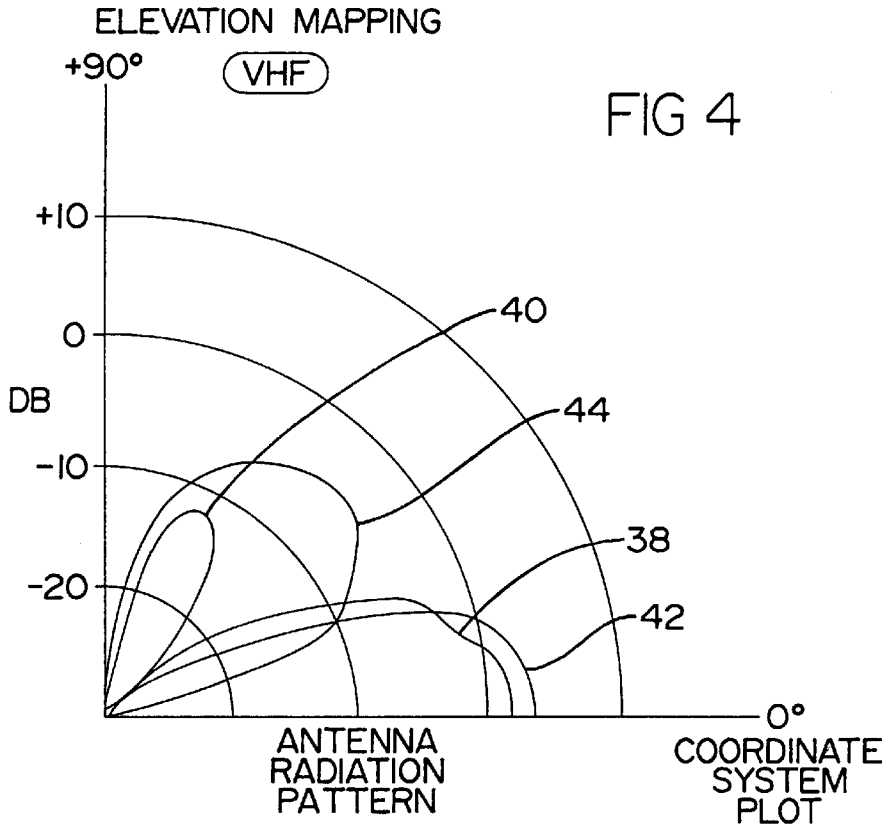
FIG. 4 is a graph comparing the VHF radiation pattern of a ⅝ wave antenna and an antenna according to the present invention.

The present invention relates to a dipole groundplane antenna for motor vehicles. The antenna may be adapted for use with a multitude of receiving systems such as those used for mobile communications, FM radio, AM radio, passive systems and the like. The antenna provides excellent directional properties, provides broader bandwidth and smoother radiation patterns than antennas of the prior art, and provides substantially easier impedance matching with a selected receiver.

Turning to FIGS. 1–3, a groundplane antenna 10 of the present invention is particularly suited for motor vehicle applications and is shown mounted to the roof 12 of a motor vehicle 14 and in electrical circuit relation with a transceiver or receiving device 16 of the motor vehicle. The antenna 10 may be installed in almost any motor vehicle such as an automobile, truck, train, or construction equipment and the like. Further, although the antenna is shown secured to the roof of an automobile, the antenna could be mounted elsewhere.

When installed into the motor vehicle 12, the motor vehicle itself will define an electrical ground potential. However, in the present invention, the antenna is electrically insulated from the motor vehicle ground potential. In other words, the antenna itself is not grounded in the present invention. Rather, the antenna is grounded through the ground of the receiving device 16 to which the antenna is connected.

The antenna 10 comprises a mounting block 18, a first radiative antenna element 20, a second radiative antenna element 22, and a third radiative antenna element 24. The radiative antenna elements 20, 22 and 24 are in the form of a wire, rod, tube or the like and extend linearly between a proximal end 20*b*, 22*b* and 24*b* and a distal end 20*a*, 22*a* and 24*a*. The radiative antenna elements are comprised of an electrically conductive material and, depending on the frequencies and allowable losses, can be manufactured from a metal coated plastic (or vice versa), copper, brass, aluminum or steel or other conductive materials known to those skilled in the art. Preferably, the radiative antenna elements are comprised of a stainless steel to provide good electrical conductivity as well as resistance to changes in the environment.

The mounting block 18 is comprised of a aluminum, stainless steel or other suitable electrically conductive material. A dielectric or other suitable electrically insulative material is inserted between the mounting block 18 and the roof 12, Preferably, the mounting block is of one-piece construction and formed to include a lower surface 26 for mounting on the insulative material, an upper surface 28, and a plurality of bores 32, 34 and 36. The bores extend between the lower and upper surfaces 26 and 28 and are configured to receive the proximal end portions of the respective radiative antenna elements 20, 22 and 24.

The bores 32, 34 and 36 are at a predetermined angle relative to the ground plane and position the respective proximal ends 20*b*, 22*b* and 24*b* together at a common point and in electrical circuit relation with one another. So secured, the radiative elements extend vertically upwardly from the common point and outwardly from the upper surface 28 of the mounting block. Preferably, each radiative antenna element is secured in its respective bore by a fastener, such as a set screw, rivet, pin or bolt (not shown).

The radiative antenna elements 20, 22 and 24 form an imaginary cone "C" with the center geometric axis "A" of the cone being disposed generally perpendicularly to the upper surface 28. The radiative antenna elements form the cone surface, the proximal ends 20*b*, 22*b* and 24*b* form the apex of the cone, and the distal ends 20*a*, 22*a* and 24*a* are circumferentially spaced at 120° to one another to form a triangular arrangement.

Preferably, the radiative antenna elements of the cone "C" have a double included angle "D" of about 40° to 90° relative to the geometric axis of the cone. That is, the radiative antenna elements, forming the cone, are at an angle "B" of about 70° to 45° relative to the ground plane (or the mounting surface 28). In a more preferred arrangement, the radiative antenna elements are disposed at an angle "B" of about 60° to the ground plane.

Preferably, the radiative antenna elements 20, 22 and 24 provide horizontal and vertical polarization and are of a different length to jointly resonate within three frequency bands. The radiative antenna element 20 is about 16¾ inches long and primarily responsive to the higher portions of the 3 bands (140–170 MHz, 200–225 MHz and 400–480 MHz). The radiative antenna element 22 is about 18½ inches long and primarily responsive to the mid-portion of the 3 bands. The radiative antenna element 24 is about 19 inches long and primarily responsive to the lower portion of the 3 frequency bands. The antenna elements 20, 22 and 24 are selected to resonate at ¼ the wavelength of the lowest transceiving frequency.

Preferably, the radiative antenna elements do not change in cross-section along their length and have the same generally cylindrical cross-section (i.e., diameter). The radiative antenna elements could differ from one another, depending on the application. For example, the conductive surface areas of the radiative antenna elements could be different. In some applications, the radiative antenna elements could be tapered, in which case the respective lengths are adjusted as appropriate to establish quarter wavelength radiating elements. Additionally, the radiative antenna elements could be of different conductive materials, or have a different electrical length or electrical surface area.

In other applications, the radiative antenna elements may be of the same physical length. Additionally, the radiative antenna elements could be extendable and retractable to lengthen or shorten the length of any or all of the antenna elements.

Figure 5:
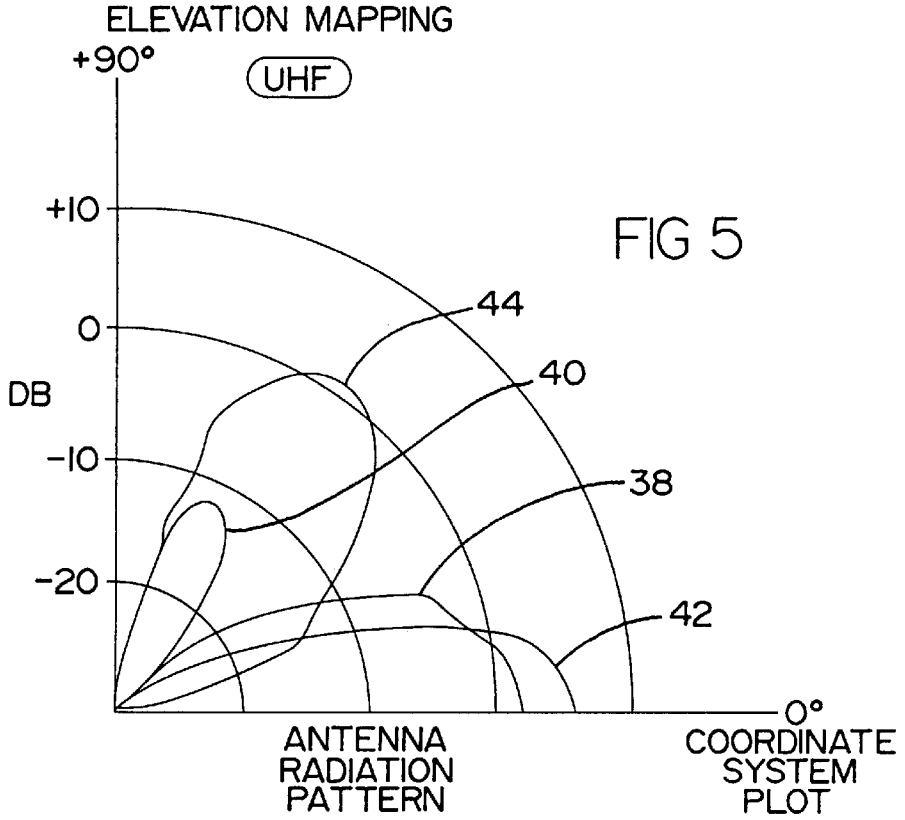
FIG. 5 is a graph comparing the UHF radiation pattern of a ⅝ wave antenna and an antenna according to the present invention.

FIGS. 4 and 5 compare the VHF and UHF antenna radiation patterns of a ⅝ wave antenna with that of the three member antenna 10 of the present invention. The radiation patterns are for a vertically polarized antenna and a dual polarized antenna according to the present invention In FIGS. 4 and 5, respectively, the VHF and UHF vertically polarized radiation patterns of a ⅝ wave antenna are shown at 38 and 40 and at 42 for the dual polarized antenna according to the invention. Similarly, the VHF and UHF dual polarized radiation patterns of an antenna of the present invention is shown, respectively, at 44 in FIGS. 4 and 5.

Advantageously, the dual polarized antenna of the present invention is much shorter than a ⅝ wave VHF antenna and a collinear UHF antenna.

The design herein is also applicable, where similar qualities are desirable, to (1) HF (shortwave) applications where wires are used for the elements suspended by non-(electrically) conductive "rope" to towers/poles/trees/buildings; and (2) wireless handheld (phones) radios with a radome for the elements where a convenient "flip-panel" would be needed, depending on operating frequency, for the (horizontal) ground plane; and (3) any portion per design of the RF spectrum with appropriate construction.

In all cases, ideally, the radius of the ground plane which may be at 90° to axis A, or alternately, at greater angles up to 160° to axis A, is minimally ¼ wavelength of the minimum transceiving frequency. Further, the shortest radiating element is ideally ⅛ wavelength of the lowest receiving frequency.

What is claimed is:

1. A dual polarization antenna for receiving and transmitting high frequency signals in conjunction with a substantially horizontal conducting vehicle panel defining a ground plane, said dual polarization antenna comprising:

a first, second and third radiative element each comprised of an electrically conductive material, each said radiative element being generally linear and extending between a proximal end and a distal end, and means mountable of the vehicle panel for securing the distal ends together at a common point and in electrical circuit relation with one another for connection to a vehicle transceiver, the radiative elements extending vertically upwardly and outwardly from said common point whereby to form an imaginary cone with the distal ends forming the apex of the cone, said radiative elements each being of a different length and disposed at an angle relative to the ground plane to provide horizontal and vertical polarization in a first, second and third frequency band.

2. The antenna as claimed in claim 1, wherein the radiative elements and distal ends are circumferentially spaced at 120°.

3. The antenna as claimed in claim 2, wherein the radiative elements forming the cone are disposed at an angle of between 15° to 45° relative to the geometric axis of the cone.

4. The antenna as claimed in claim 3, wherein the radiative elements forming the cone are disposed at an angle of about 60° relative to the ground plane.

5. The antenna as claimed in claim 2, wherein the radiative elements forming the cone are disposed at an angle of about 60° relative to the ground plane.

6. The antenna as claimed in claim 1, wherein said vehicle panel defines an electrical ground potential and said dual polarization antenna is electrically insulated from said vehicle panel ground potential.

7. The antenna as claimed in claim 1, wherein the length of the first, second and third radiative element is, respectively, about 16 inches, 17¾ inches and 18¼ inches.

8. The antenna as claimed in claim 1, wherein the length of the respective radiative elements causes the antenna to respond to the frequency bands of about 140–170 MHz, 200–225 MHz and 400–480 MHz.

9. The antenna as claimed in claim 1, wherein the radiative elements are electrically conductive and selected from the group consisting of a metal coated plastic, copper, brass, aluminum or stainless steel.

10. A dual polarization antenna for receiving and transmitting high frequency signals in conjunction with a substantially horizontal conducting vehicle panel defining a ground plane, said dual polarization antenna comprising:

three electrically conductive antenna elements, each said element having a first end and a second end and a respective length of about 16 inches, 17¾ inches and 18¼ inches, and a mounting block comprised of a dielectric material adapted to be mounted to the vehicle panel, said mounting block electrically insulating said antenna elements from the vehicle ground plane and mounting said antenna elements into a triangular arrangement such that said first ends are in electrical circuit path relation with one another for connection to a vehicle transceiver and the second ends are spaced vertically upwardly and above said mounting block, said antenna elements being disposed at an angle to the ground plane and of a different length whereby to receive horizontally and vertically polarized components and jointly resonate within the frequency bands of about 140–170 MHz, 200–225 MHz and 400–480 MHz.

11. A dual polarization antenna for receiving and transmitting high frequency signals in conjunction with a substantially horizontal conducting vehicle panel defining a ground plane, said dual polarization antenna comprising:

an electrically conductive first, second and third antenna element to receive horizontally and vertically polarized components and jointly resonate within three separate frequency bands, each said element being axially elongated and having a first end and a second end, and a mounting block comprised of a dielectric material adapted to be mounted to the vehicle panel, said mounting block electrically insulating said first, second and third antenna elements from the vehicle ground plane and securing said antenna elements into a triangular arrangement such that said second ends are in electrical circuit path relation with one another and the first ends are spaced vertically upwardly and above said mounting block and circumferentially spaced at 12°, said first, second and third antenna elements forming an imaginary cone, the center axis of which is generally perpendicular to the ground plane of the vehicle and each of the elements being disposed at an angle of between 45° to 70° relative to the ground plane.

* * * * *